US009920952B2

(12) United States Patent
Lesage

(10) Patent No.: US 9,920,952 B2
(45) Date of Patent: Mar. 20, 2018

(54) WATER STRATIFICATION DRUM FOR WATER HEATER

(71) Applicant: MICLAU-S.R.I. Inc., Montreal-East (CA)

(72) Inventor: Jean-Claude Lesage, Kirkland (CA)

(73) Assignee: MICLAU-S.R.I. INC., Montreal East, Quebec ( * ) Notice: Subject to any disclaimer, the term of this patent is extended or adjusted under 35 U.S.C. 154(b) by 127 days.

(21) Appl. No.: 14/757,281

(22) Filed: Dec. 14, 2015

(65) Prior Publication Data

US 2017/0167754 A1 Jun. 15, 2017

(51) Int. Cl.
*F24H 9/00* (2006.01)
*F24H 1/20* (2006.01)
*F24H 9/12* (2006.01)

(52) U.S. Cl.
CPC ..... *F24H 9/0015* (2013.01); *F24H 1/205* (2013.01); *F24H 9/124* (2013.01)

(58) Field of Classification Search
CPC ..... F22B 13/10; F22B 13/023; F22B 37/00; F22B 9/02; F22B 9/04; F24H 1/22; F24H 1/50; F24H 1/207; F24H 9/124; F24H 1/122; F24H 1/125; F24H 1/128; F24H 9/0015; F24H 1/205; F28D 2020/0069; F28D 2020/0086
See application file for complete search history.

(56) References Cited

U.S. PATENT DOCUMENTS 2,207,057 A * 7/1940 Gulick ..... F24H 9/124 122/19.1
5,474,673 A * 12/1995 Ludlow ..... A01K 63/045 119/260
8,910,880 B2 * 12/2014 Farrell ..... F24D 3/08 122/15.1
9,638,439 B2 * 5/2017 Shaffer ..... F24H 9/124
2009/0022484 A1 * 1/2009 Kondo ..... F22B 37/02 392/325
2013/0032100 A1 * 2/2013 Wepfer ..... F22B 1/025 122/4 R
2016/0138827 A1 * 5/2016 Lesage ..... F24H 8/00 122/18.31
2017/0023275 A1 * 1/2017 Jonsson ..... F24D 11/002
2017/0198987 A1 * 7/2017 Vanderwees ..... F28F 27/00

FOREIGN PATENT DOCUMENTS

CA 2911916 A1 * 5/2017

* cited by examiner

*Primary Examiner* — Gregory A Wilson
(74) *Attorney, Agent, or Firm* — Houle Patent Agency Inc.

(57) ABSTRACT

A water stratification drum for use in an electric and condensing water heater is disposed in a lower portion of the water holding tank and across the circumferential side wall of the tank. The water stratification drum has a pair of plates held spaced-apart by support members which extend between the pair of plates to maintain the plates in substantially parallel relationship. A cold water zone is defined between the plates and cool domestic water is introduced in the tank between the plates. The plates are flat disc plates formed on non-corrosive material and water there between is diffused in a controlled manner to other regions of the tank through at least one of the plates being perforated. The diffusion of the water prevents premature actuation of the heat source by not causing an abrupt change in the temperature of the hot water in the tank.

25 Claims, 4 Drawing Sheets

WATER STRATIFICATION DRUM FOR WATER HEATER

TECHNICAL FIELD

The present invention relates to a stratification drum for installation inside the water holding tank of a water heater to restrain cooler water within a lower portion of the tank from quickly dissipating into the hotter water in other parts of the tank.

BACKGROUND OF THE INVENTION

There is a continuing need to improve the efficiency of water heaters. One such need is to control the cold water introduce in the water holding tank of the water heater, usually in the bottom region of the tank. When cold water is introduced in the tank it immediately mixes with the hot water resulting in a temperature drop of the hot water and prematurely lowering the temperature below the set point and triggering a demand for the heating source to heat the water, resulting in energy use. It is therefore desirable to control the flow of the cold water introduced in the tank and this applies to both electric and condensing water heaters.

With respect to condensing water heaters, it would be desirable to heat the cold water as it is introduced in the lower region of the tank before it is released in the upper hotter region of the tank. Still further, it would also be desirable to use the cold water introduce in the bottom region of the tank to further cool the hot gases released in the flue and at the same time use the heated cool water.

Known means of increasing the efficiency of flue heat recovery in condensing water heaters, is to use external heat exchange devices through which the flue gases are convected in heat exchange relationship with water which is heated thereby and used for a variety of other purposes. It is desirable to reduce the flue gases typically below 130 degrees Fahrenheit before releasing the gas vapours to atmosphere. More recently, new flue designs have been proposed where the primary central flue is connected to a secondary flue which is disposed inside the water tank for subjecting the hot gases to a second heat exchange pass with the water contained in the tank before being convected to atmosphere. Such designs results in increase costs and has added to the size of the water heater including additional external components.

SUMMARY OF THE INVENTION

It is a feature of the present invention is to provide a condensing water heater wherein a water stratification drum is disposed in a lower portion of the tank to harness the cooler water to create a cooler water strata to retard its mixing with the hotter water in the tank.

A further feature of the present invention is to provide an electric water heater wherein a water stratification drum is disposed in a lower portion of the tank for receiving therein the water supply to restrain the cooler water and retard its admixture with the hot water in the upper portion of the tank resulting in energy conservation and cost savings to the customer and the utility.

A further feature of the present invention is to provide a condensing water heater wherein a water stratification drum is disposed in a lower portion of the tank to harness the cooler water and to direct it in the area of the combustion chamber hot surface region to preheat the cooler water at the bottom of the tank before it is mixed with the hotter water in the upper portion of the tank.

Another feature of the present invention is to provide a condensing water heater wherein a water stratification drum is disposed in a lower portion of the tank to harness the cooler water to create a cooler water strata and wherein water from this strata is pumped through an external heat exchange device in communication with the hot flue gases from the central flue to extract heat therefrom and return the heated water from the heat exchange device to the upper part of the tank.

According to the above features, from a broad aspect, there is provided a water heater having a water holding tank and water heating means associated therewith to heat water in the tank. A water stratification drum is disposed in a lower portion of the tank above a bottom wall of the tank and across a circumferential side wall of the tank. The water stratification drum has a pair of plates held spaced apart by support means. At least one of the plates has perforations therein sized to provide restraining flow communication of cooler water between the plates with water in a lower portion of the tank. A cold water inlet has a discharge end disposed intermediate the pair of plates. A hot water outlet is provided in a top portion of the tank. When hot water is drawn from the hot water outlet, cooler water is admitted between the plates and released in a restraining manner in a lower portion of the tank to retard its admixture with water in the other portions of the tank.

According to a further broad aspect of the present invention there is provided a water stratification drum for use in a water holding tank of a water heater. The water stratification drum has a pair of plates held spaced apart a predetermined distance by support means. The plates are flat disc plates formed from non-corrosive material. At least one of the plates is a perforated disc plate to provide flow communication of cooler water between the plates to another portion of the water holding tank.

According to a still further broad aspect of the present invention, the water stratification drum is adaptable for use with electric and condensing water heaters and modifications thereof.

BRIEF DESCRIPTION OF THE DRAWINGS

A preferred embodiment of the present invention will now be described with reference to the examples thereof as illustrated by the accompanying drawings in which.

DETAILED DESCRIPTION

Figure 1A:
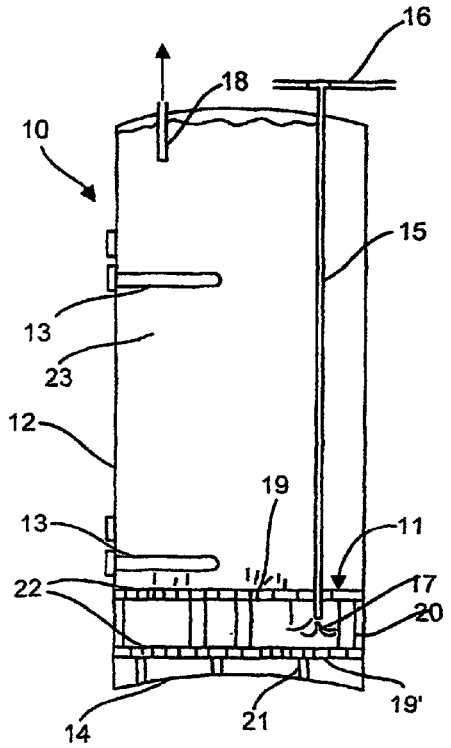
FIG. 1A is a simplified schematic view of an electric water heater fitted with the water stratification drum of the present invention.
Figure 2B:
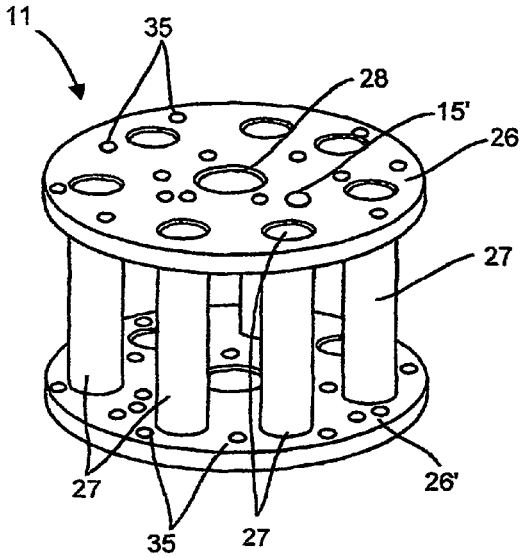
FIG. 2B is a perspective view illustrating a further example of the construction of the water stratification drum for use in a condensing water heater.
Figure 2A:
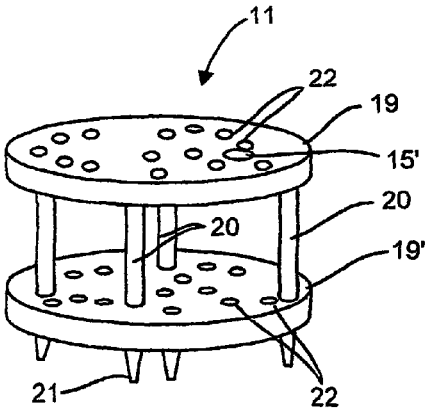
FIG. 2A is a perspective view illustrating an example of the construction of the water stratification drum for use in an electric water heater.

Referring now to the drawings and more specifically to FIGS. 1A and 2A, there is shown generally at 10 a schematic illustration of an electric water heater equipped with the water stratification drum 11 of the present invention. Has herein shown, the water stratification drum 11 is positioned water heating tank 12 under the lower resistive heating element 13 above the bottom wall 14 of the tank. A dip tube 15 supplying domestic cold water from the supply line 16 extends into the water stratification drum to admit water in the tank from its discharge end 17 when hot water is withdrawn from the upper part of the tank through the outlet pipe 18.

As illustrated in FIG. 2A, the water stratification drum 11 is comprised by a pair of plates 19 and 19' held spaced apart in substantially parallel relationship by support means constituted herein by spacer rods 20 secured to and between the plates 19 and 19'. Support legs 21 extend outwardly from the bottom plate 19' to support the water stratification drum 11 with the bottom plate 19' elevated on a support surface. The plates 19 and 19' are flat disc plates constructed of non-corrosive material, such as a suitable plastic material, unaffected by the water temperature in the tank of a water heater, either domestic or commercial. The spacer rods 20 and the support legs 21 are also constructed of non-corrosive material whereby the entire assembly does not draw from the sacrificial anode (not shown) and common with water heaters. As herein shown, both plates are provided with perforations 22, of predetermined size, for the passage of water released under pressure from the discharge end 17 of the dip tube 15 between the plates to diffuse the cold water into in a restraining manner in the bottom portion of the tank and slowly mixing into the upper portion of the tank to more slowly mix with the hotter water 23 therein wherein not to cause an abrupt drop in water temperature of the hot water below the set point temperature thereby triggering one or both heating elements to be activated prematurely. Although, the perforations 22 in both plates 19 and 19' are of the same size and same quantity, the perforations 22 in the uppermost plate 19 may be fewer or of smaller size whereby more of the cold water admitted between the plates is released in the lowest part of the tank. Still further, the top plate 19 may be a solid plate with no perforations whereby all the water in the water stratification drum is directed downwards in the bottom portion of the tank 12. A dip tube hole 15' is provided in the top plate 26 of the water stratification drum for the passage of the dip tube.

Figure 1B:
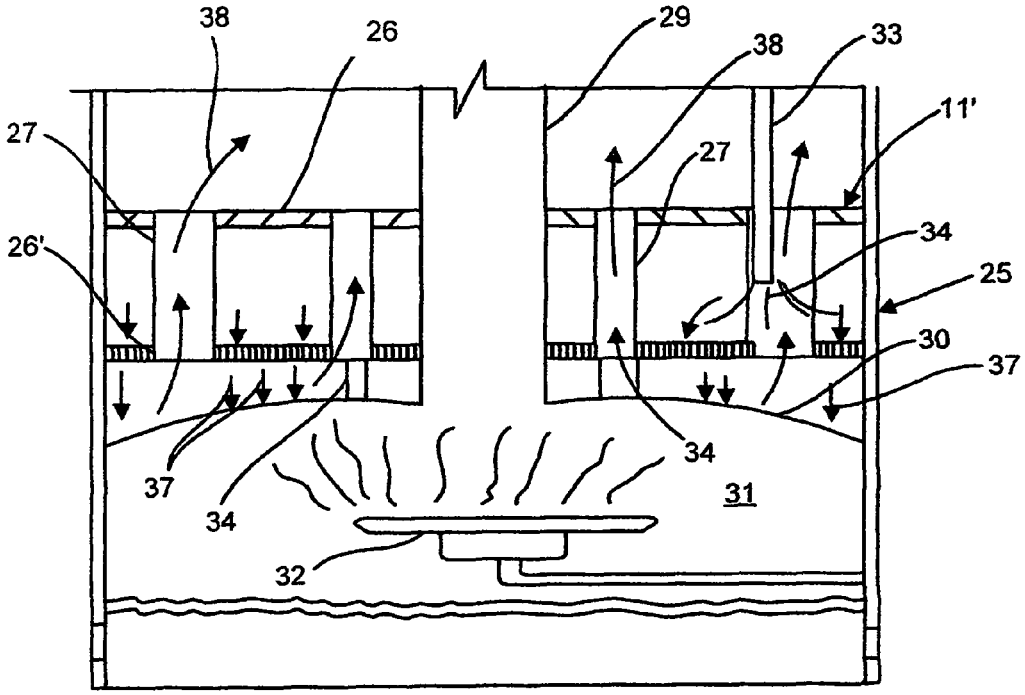
FIG. 1B is a fragmented schematic view of a lower portion of a condensing water heater fitted with a modified version of the water stratification drum of the present invention.
Figure 3:
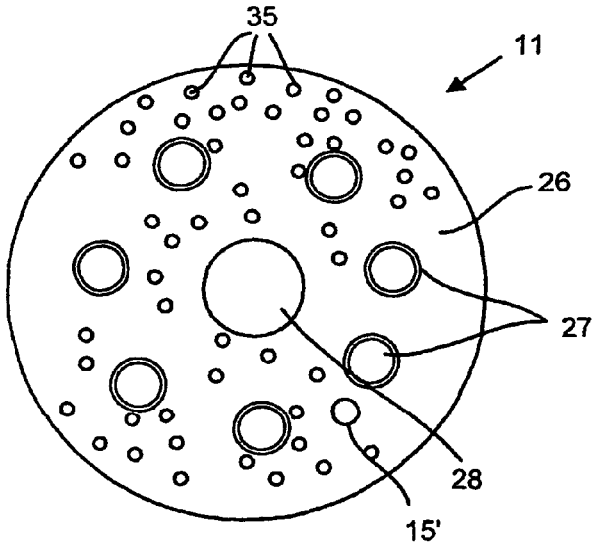
FIG. 3 is a top view of the water stratification drum of FIG. 2B.

Referring now to FIGS. 1B, 2B and 3, there is shown a fragmented section view of a condensing water heater tank 25 fitted with a modified version of the water stratification drum 11' of the present invention. The water stratification drum 11' is similar to the drum 11 of FIG. 2A with a pair of disc plates 26 and 26' but these are supported in spaced parallel relationship by transverse conduits 27 extending through and between the diffuser plates and secured thereto. The plates 26 and 26' are further provided with a circular central hole 28 aligned with one another for the passage of the central flue pipe 29 extending from the bottom wall 30 of the tank which is the top wall of the combustion chamber 31 heated by the burner 32 supported thereunder.

Figure 2C:
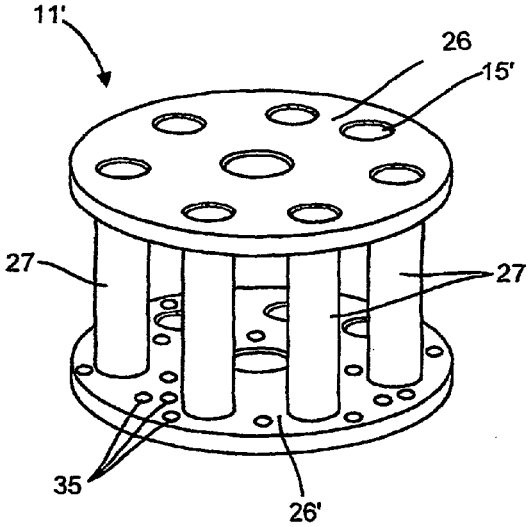
FIG. 2C is a perspective view illustrating a still further example of the construction of the water stratification drum for use in a condensing water heater.

As shown in FIG. 2B, both plates 26 and 26' are perforated. However, it is desirable with condensing water heaters to direct the cold water from the dip tube as close as possible to the bottom wall 30 of the tank 25. The water stratification drum 11' is positioned to sit close to the bottom wall 30 and as shown in FIG. 1B its support legs 34 rest on the bottom wall 30 spaced from the central flue pipe 29. The top plate 26 is made as a solid plate as illustrated in FIG. 2C and therefore only the bottom plate 26' is provided with perforations 35 sized to provide flow of cold water released between the plates 26 and 26' from the discharge end 34 of the dip tube 33 downwardly in the direction of the bottom hot wall of the tank to be heated and mixed with the water below the water stratification drum before being released through the transverse conduits 27 into the upper region of the tank for admixture with the hot water therein. Accordingly, the hot water in the upper region is not subjected to an abrupt temperature drop as would be the case if the cold water from the dip tube was freely released in the tank in an unrestricted manner, as is presently the case with conventional water heaters. As illustrated by the arrows in FIG. 1B, water is discharged under pressure (household water supply line pressure) between the plates 26 and 26' from the discharge end 34 of the dip tube 33. Because the top plate 26 is a solid plate, this cold water is pushed through the perforations 35 in the bottom plate 26' and as shown by arrows 37 the cold water is directed against the bottom hot wall 30 of the tank to be heated. The heated water is then drawn out, as shown by arrows 38, through the transverse conduits 27 and into the region of the tank above the water stratification drum to mix with the hot water therein. Accordingly, the hot water is not subjected to an abrupt temperature change by the release of cold water and there is an energy saving by controlling the release of the cold water from the domestic supply in the lowest portion of the tank where it is heated before admixture with the hotter water in the other upper regions of the tank.

Figure 4:
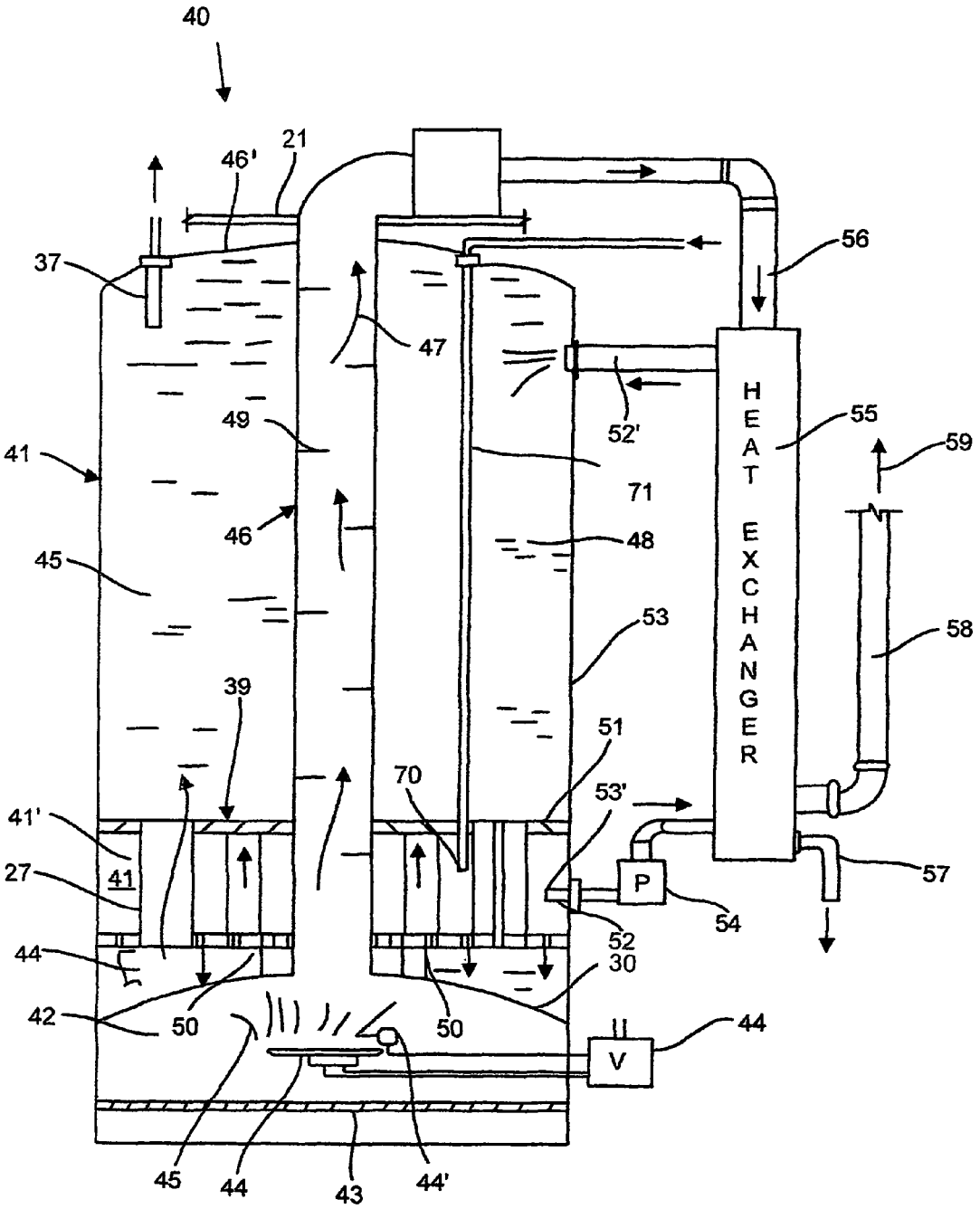
FIG. 4 is a simplified schematic section view illustrating a condensing gas-fired water heater in which is secured the water stratification drum of the present invention and wherein water from inside the drum is circulated through an external heat exchange device to extract heat and back into the upper portion of the tank.

Referring now to FIG. 4, there is shown a further application of the water stratification drum 39 in a condensing water heater. As illustrated the condensing water heater 40 is comprised of a water holding tank 41. Although not illustrated, the water holding tank 41 is insulatingly disposed in an external casing 21, a fragment only illustrated. A combustion chamber 42 is formed under the bottom wall 43 of the tank 41. A gas burner 44 is secured in the combustion chamber to produce hot flames 45 to heat the bottom wall 43 and water in the tank. A central flue 46 channels the hot gases from the combustion chamber and extends from the bottom wall 43, through the tank 41 and exit the top wall 46'. Hot flue gases 47 propagating upwardly in the central flue heat the water 48 contained in the tank 41 in contact with the central flue 46. Baffle plates 49 secured in the flue 46 retard the flue gases 47 and cause turbulence thereof to improve heat exchange between the hot flue gases and the water 48 in the tank 41. Ambient air 4 is admitted into the combustion chamber through an explosion proof bottom screened wall 43. A gas valve 44 controls the flow of gas to the burner 44 and the pilot 44'.

As herein shown, the water stratification drum 39 is disposed in a lower portion 41' of the tank 41 and arrested in position by its support legs 50 or other suitable means such as connectors (not shown but obvious to a person skilled in the art) and is closely spaced to the bottom wall 43. A space 44 is created above the bottom wall 43 under the water stratification drum 39 wherein very hot water is produced. The drum is constructed as illustrated in FIG. 2C and described.

As herein shown, a heat exchange conduit 52 is secured to the tank side wall 53 adjacent the cooler water zone. 51 and has an inlet end 53' in flow communication with the cooler water zone 51 to extract water therefrom. Preferably the inlet end 53' is disposed close to the discharge end 70 of the dip tube 71 to re-circulate the cooler water admitted between the diffuser plates 41 of the drum 39 when hot water is withdrawn from the tank 41. A pump 54 is secured to the heat exchange conduit 52 for displacing water from the cooler water zone 51 through an external heat exchanger device 55 which is in heat exchange relationship or communication with an external flue pipe section 56 of the central flue 46 to extract heat therefrom to further cool the exhaust flue gases and simultaneously heat the water from the cooler water zone. The heat exchange conduit 52 has a return conduit section 52' for returning the heated water from the heat exchanger device 55 to the upper portion 45 of the tank 41 above the water stratification drum 39 when the pump 54 is actuated automatically upon actuation of the burner 44, when the temperature in the tank fall below a set point value or hot water is drawn from the tank.

The heat exchanger 55 is not described and can have a variety of constructions as is well known in the art wherein to provide heat exchange between the hot gas of the flue and a cold water conduit disposed in direct contact with the hot gases or the flue pipe. As herein illustrated the heat exchanger 55 is provided with a condensate trap in a lower end thereof which is connected to a condensate evacuation pipe 57. An exhaust pipe 58 exhausts the flue gases 59 which have been cooled, to atmosphere by suitable conduits, usually PVC piping.

Figure 5:
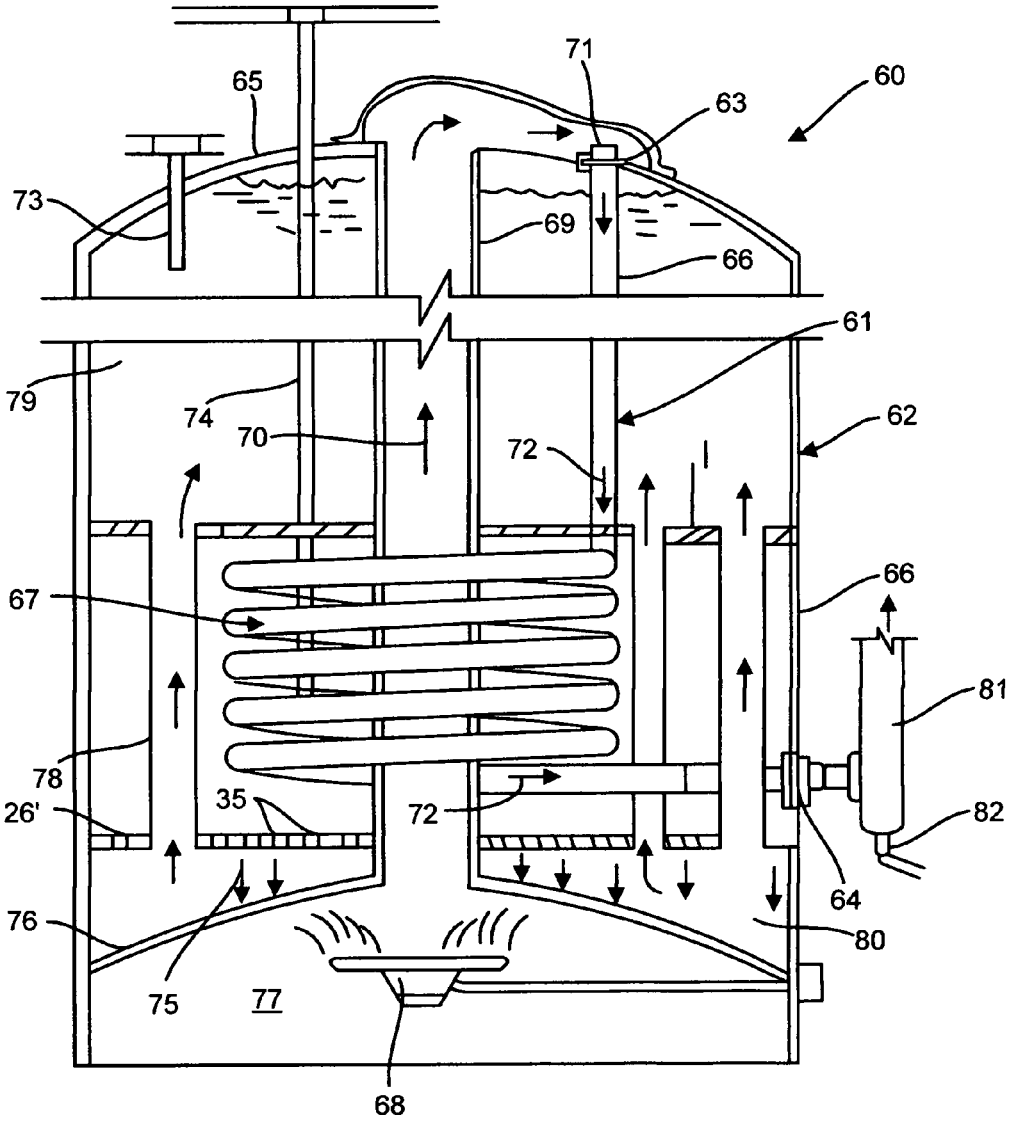
FIG. 5 is a fragmented simplified schematic section view of a condensing gas-fired water heater in which is secured the water stratification drum of the present invention and wherein the central flue is merged into a dielectric secondary flue extending inside the tank and having a coil lower section disposed inside the cooler water zone of the water stratification drum.

With reference to FIG. 5 there is shown, generally at 60, a condensing water heater which incorporate a secondary flue pipe 61 extending inside the water tank 62. The secondary flue pipe 61 has dielectric connectors 63 and 64 connected, respectively, to the top wall 65 and side wall 66 at a lower end of the tank. The secondary flue pipe 61 has a straight downwardly extending section 66 and a coil section 67 at a lower end region thereof to improve heat exchange with the water in the tank 62. In order to further improve the efficiency of the water heater, the water stratification drum 11' is mounted inside the tank to receive therein the coil section 67 of the secondary flue pipe 61. Therefore, when the burner 68 is turned on the hot gases flow up the primary flue pipe 69, as shown by arrow 70, and into the top end 71 of the secondary flue pipe 61 and down into the coil section 67, as shown by arrows 72 where it is in heat exchange with the cooler water captured in the water stratification drum 11'.

When there is a demand for hot water through the hot water outlet conduit 73, hot water is drawn out of the tank and cold water is admitted into the water stratification drum 11' through the dip tube 74. This cold water increases the delta-T between the hot gases in the coil section 67 and the surrounding water in the water stratification drum 11', thereby resulting in an increase in the efficiency of the condensing water heater 60. As previously described with reference to FIG. 1B, the water in the drum 11' is also pushed out of the drum through the perforations 35 in the bottom plate 26', due to the pressure in the water supply from the dip tube 74, in a downward direction, as shown by arrows 75, in the direction of the bottom wall 76 of the tank which is the top wall of the combustion chamber 77 to be further heated and convected upwardly through the conduits 78 into the top part 79 of the tank. Accordingly, the cold domestic water from the dip tube 74 is heated inside the water stratification drum 11' containing the coil section 67 of the secondary flue pipe 61 and the lower region 80 of the tank before it is convected for admixture with the hotter water in the top region 79 of the tank. The cooler gases from the coil section 67 of the secondary flue pipe 61 are released to atmosphere through an exhaust pipe 81 fitted with a condensate collection P-trap 82.

As can be appreciated, the water stratification drum of the present invention is applicable for use in both electric and condensing water heaters and provides a control of the cold water supply introduced in the water heaters when there is a demand for hot water. By harnessing the cooler water introduced in the tank of the water heater and controlling the flow thereof by the use of a water stratification drum as herein described, it results in an energy saving by preventing premature activation of the heating sources or the use of the cooler water to cool the condensate gases and simultaneously using the hot gases to heat the cooler water introduced in the tank.

It is within the ambit of the present invention to cover any obvious modifications of the examples described herein, provided such modifications fall within the scope of the appended claims.

The invention claimed is:

1. A water heater comprising a water holding tank, water heating means associated with said water holding tank to heat water therein, a water stratification drum disposed in a lower portion of said tank above a bottom wall of said tank and across a circumferential side wall of said tank, said water stratification drum having a pair of plates held spaced apart by support means, at least one of said plates having perforations therein sized to provide restraining flow communication of cooler water between said plates with water in a lower portion of said tank, a cold water inlet having a discharge end disposed intermediate said pair of plates, a hot water outlet in a top portion of said tank; and wherein when hot water is drawn from said hot water outlet, cooler water is admitted between said plates and released in a lower portion of the tank to retard its admixture with hotter water in other portions of said tank.

2. The water heater as claimed in claim 1 wherein said plates are diffuser plates formed from non-corrosive material.

3. The water heater as claimed in claim 2 wherein said perforations are through passages of predetermined size and wherein both said diffuser plates are provided with said through passages.

4. The water heater as claimed in claim 3 wherein said perforations in a top one of said diffuser plates are smaller than the perforations in a bottom one of said pair of diffuser plates, said diffuser plates having approximately equal numbers of perforations.

5. The water heater as claimed in claim 2 wherein said support means are support spacer rods secured to and between said pair of plates to support said plates in substantially parallel relationship.

6. The water heater as claimed in claim 5 wherein said inlet end of said heat exchange conduit comprises and inlet pipe extending between said diffuser plates and terminating in close proximity to said discharge end of said dip tube.

7. The water heater as claimed in claim 2 wherein said support means is constituted by transverse conduits extending through and between said pair of diffuser plates.

8. The water heater as claimed in claim 2 wherein a top one of said diffuser plates is provided with a hole for receiving there through an end portion of a dip tube with an open end of said dip tube terminating between said diffuser plates.

9. The water heater as claimed in claim 2 wherein said diffuser plates are each provided with a circular hole positioned in alignment for the passage of a flue pipe of a condensing gas-fired water heater.

10. The water heater as claimed in claim 2 wherein said water heater is an electrical water heater, said water stratification drum being disposed below a lower one of electrical resistive heating elements of said electrical water heater, and wherein both diffuser plates of said pair of diffuser plates are perforated diffuser plates.

11. The water heater as claimed in claim 1 wherein a bottom one of said pair of plates is formed with projecting support means projecting from a bottom surface thereof to support said water stratification drum at an elevated position on said bottom wall of said tank.

12. The water heater as claimed in claim 1 wherein said water heater is a condensing water heater having a water holding tank, a combustion chamber under a bottom wall of said tank, a gas burner in said combustion chamber, a flue in communication with said combustion chamber and extending through said tank to exit through a top wall of said tank for convecting hot gases through said tank in heat exchange with water therein, transverse conduits extending through and between said pair of plates and secured to said plates to constitute said support means.

13. The water heater as claimed in claim 12 wherein said condensing water heater is a high efficiency water heater, and wherein there is further provided a heat exchange conduit having an inlet in flow communication with said cooler water zone defined between said plates, a pump connected to said heat exchange conduit for displacing water from said cooler water zone through a heat exchange device in heat exchange communication with an external flue pipe section of said flue to extract heat therefrom to cool said exhaust gases and simultaneously heat said water from said cooler water zone in said heat exchange conduit, said heat exchange conduit having a return conduit section for returning said heated water from said heat exchange device to a section of said tank above said water stratification drum when said pump is actuated upon actuation of said burner.

14. The water heater as claimed in claim 13 wherein said plates are flat perforated diffuser plates having a disc shape.

15. The water heater as claimed in claim 13 wherein said cold water inlet is a dip tube providing domestic water to said tank when hot water is drawn from said upper portion of said tank, said inlet end of said heat exchange conduit being disposed in close proximity to said discharge end of said dip tube.

16. The water heater as claimed in claim 12 wherein said transverse conduits are cylindrical conduits having a diameter sufficient to provide unrestricted flow of hot water from under said stratification drum heated by said bottom wall in contact with said combustion chamber and into an upper portion of said tank above said stratification drum.

17. A water stratification drum for use in a water holding tank of a water heater, said water stratification drum having a pair of plates held spaced apart a predetermined distance by transverse conduits extending through and between said pair of plates and being secured at opposed ends thereof to said pair of plates for supporting said plates substantially parallel to one another, said plates being flat disc plates formed from non-corrosive material, at least one of said plates being a perforated disc plate to provide flow communication of cooler water between said plates to another portion of said water holding tank.

18. The water stratification drum as claimed in claim 17 wherein said transverse conduits are cylindrical conduits having a diameter sufficient to provide unrestricted flow of hot water from under said stratification drum and into an upper portion of said tank above said stratification drum.

19. The water stratification drum as claimed in claim 17 wherein a bottom one of said pair of plates is formed with projecting support means projecting from a bottom surface thereof to support said water stratification drum at an elevated position on said bottom wall of said tank.

20. The water stratification drum as claimed in claim 17 wherein said support means are support rods interconnecting said disc plates in spaced-apart substantially parallel relationship.

21. The water stratification drum as claimed in claim 17 wherein said perforations are through passages of predetermined size and wherein both said flat disc plates are provided with said through passages.

22. The water stratification drum as claimed in claim 21 wherein said perforations in a top one of said diffuser plates are smaller than the perforations in a bottom one of said pair of diffuser plates, said diffuser plates having approximately equal numbers of perforations.

23. The water stratification drum as claimed in claim 17 wherein a top one of said diffuser plates is provided with a hole for receiving therethrough an end portion of a dip tube with an open end of said dip tube terminating between said diffuser plates.

24. The water stratification drum as claimed in claim 17 wherein said diffuser plates are each provided with a circular hole positioned in alignment for the passage of a flue pipe of a condensing gas-fired water heater.

25. The water stratification drum as claimed in claim 17 wherein said water heater is one of an electric water heater and a condensing gas-fired water heater.

* * * * *